United States Patent [19]

Berne

[11] 4,273,063

[45] Jun. 16, 1981

[54] SHIP STABILIZER

[75] Inventor: Jean Berne, Le Havre, France

[73] Assignee: Societe Nouvelle des Ateliers et Chantiers du Havre, Seine-Maritime, France

[21] Appl. No.: 47,785

[22] Filed: Jun. 11, 1979

[30] Foreign Application Priority Data

Jun. 19, 1978 [FR] France ..... 78 18241
Nov. 2, 1978 [FR] France ..... 78 31072

[51] Int. Cl.[3] ..... B63B 39/06
[52] U.S. Cl. ..... 114/126; 92/113; 244/215
[58] Field of Search ..... 114/126, 162, 280, 282; 92/108, 113; 244/82, 215; 74/522

[56] References Cited

U.S. PATENT DOCUMENTS

| | | | |
|---|---|---|---|
| 254,309 | 2/1882 | Hanna | 92/113 X |
| 2,550,752 | 5/1951 | Allan | 114/126 |
| 2,991,748 | 7/1961 | Muirhead et al. | 114/126 |
| 2,998,794 | 9/1961 | Beach | 114/126 |
| 3,015,298 | 1/1962 | Bell et al. | 114/126 |
| 3,456,612 | 7/1969 | Rieprich | 114/126 |
| 4,023,516 | 5/1977 | Bennett | 114/126 |
| 4,089,392 | 5/1978 | Ostrowski | 92/108 |

*Primary Examiner*—Sherman D. Basinger
*Attorney, Agent, or Firm*—Browdy and Neimark

[57] ABSTRACT

The ship stabilizer comprises at least two retractable fins mounted on both sides of the hull of the ship, housings being formed within the hull below the floating line of the ship for engaging therein the fins in the retracted condition.

12 Claims, 18 Drawing Figures

53
59
58
119
119
20.
19
19
15
17c
15
17b
18
17a
17a
17
6c
14
14
53
17
6d
153
56
153a
6g
55
27
5
6
7
7a
7a
7
8
9
6a
9
10
10
3b
11
10b
13
11
11

3

153c
53
59
119
58
119
20.
19
19
15
17c
15
17b
18
17a
17a
17
6c
14
14
17
6d
153b
153
56
153a
6g
55
27
5
6
7
7a
7a
7
8
9
6a
9
10
10
3b
11
10b
13
11
11

SHIP STABILIZER

The present invention relates to a ship stabilizer made of two fins which, when the sea is calm, are retracted so as not to reduce the speed of the ship.

Many ships are at present equipped with roll-damping devices, and particularly ships constructed for the transportation of containers, in order to prevent these containers from moving by heavy seas and causing accidents likely to imperil the ship.

Three methods of ship stabilization are particularly known:

a first method consists in filling with water some compartments of the ship (passive stabilization);

a second method consists in displacing a liquid mass by means of a piston;

a third method provides the ship with fixed roll-damping fins. However, said roll-damping fins have the disadvantage of considerably reducing the speed of the ship due to the resistance which such stabilizers offer to the penetration into the water, which increases the consumption of energy when the sea is calm, and also of being detrimental as they continuously protrude from the hull.

The present invention remedies such disadvantages by providing a stabilizer formed of two fins placed on either side of the hull and which are retracted by being housed inside recesses formed in the hull so as to offer no resistance to the progression of the ship when the weather is fine and which are extracted when the sea and the wind create conditions such that the roll becomes very important and may cause damages either to the ship or the freight it carries. These retractable fins are positioned at substantially the rear third portion of the length of the ship, in the area where the water lines are unlikely to be disturbed. In some cases, particularly when the ships are very long, two pairs of retractable fins may be provided, the first pair being substantially in the area of the front third portion of the length, and the second pair approximately in the vicinity of the second third portion of the length of the ship, therefore in the vicinity of the stern.

According to the invention, the ship stabilizer with retractable fins is formed of at least two fins placed on either side of the hull and which may be folded back and retracted inside housings formed in the hull below the floating line, the retraction being effected according to the facilities which are aboard the ship, either towards the head or towards the stern.

Various further characteristics of the invention will become more apparent from the following detailed description of some embodiments thereof, given as non-limitative examples, reference being made to the accompanying drawings wherein.

Figure 1:
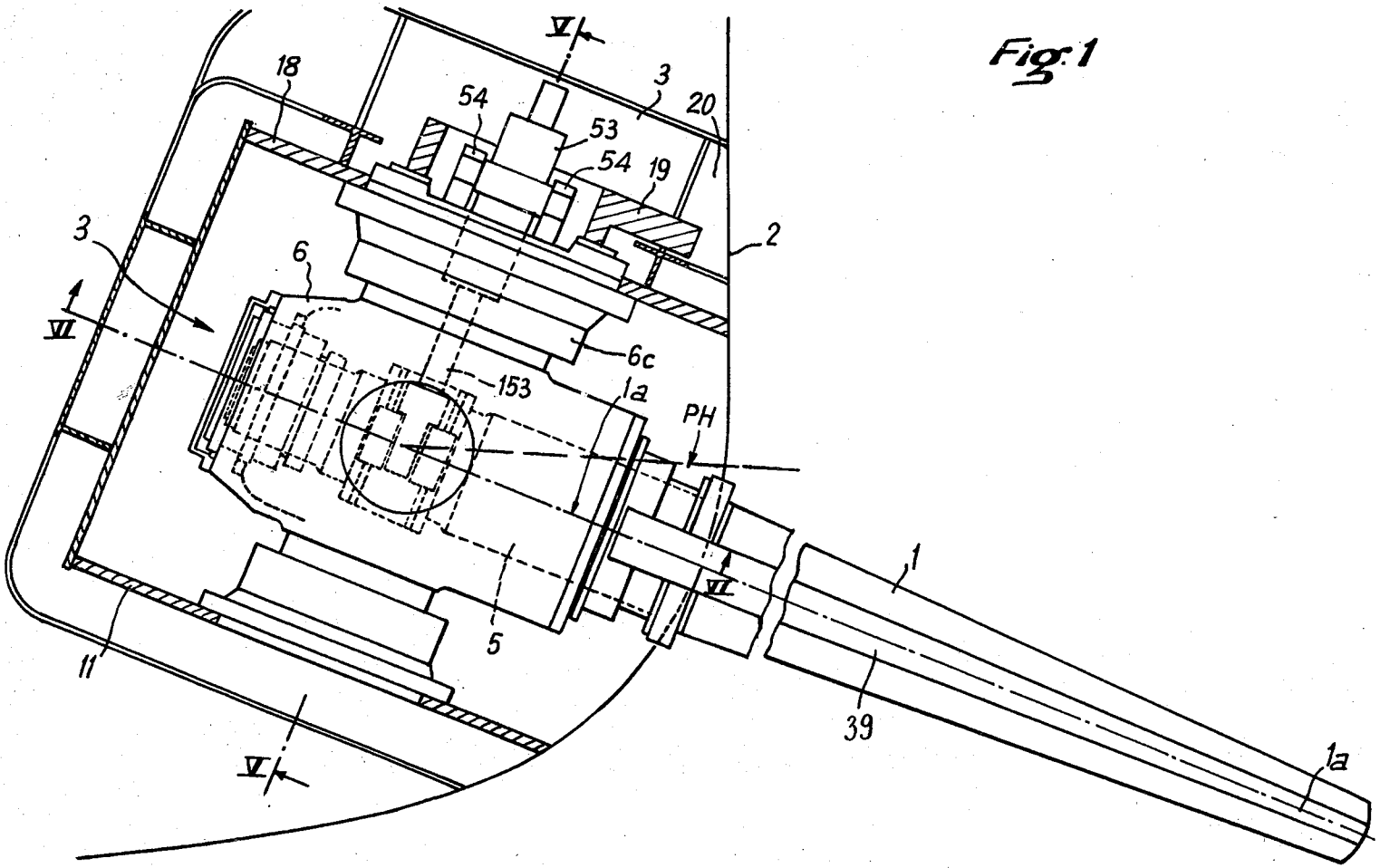
FIG. 1 is a front elevation, partly in cross-section, of a fin in the extracted position.
Figure 2:
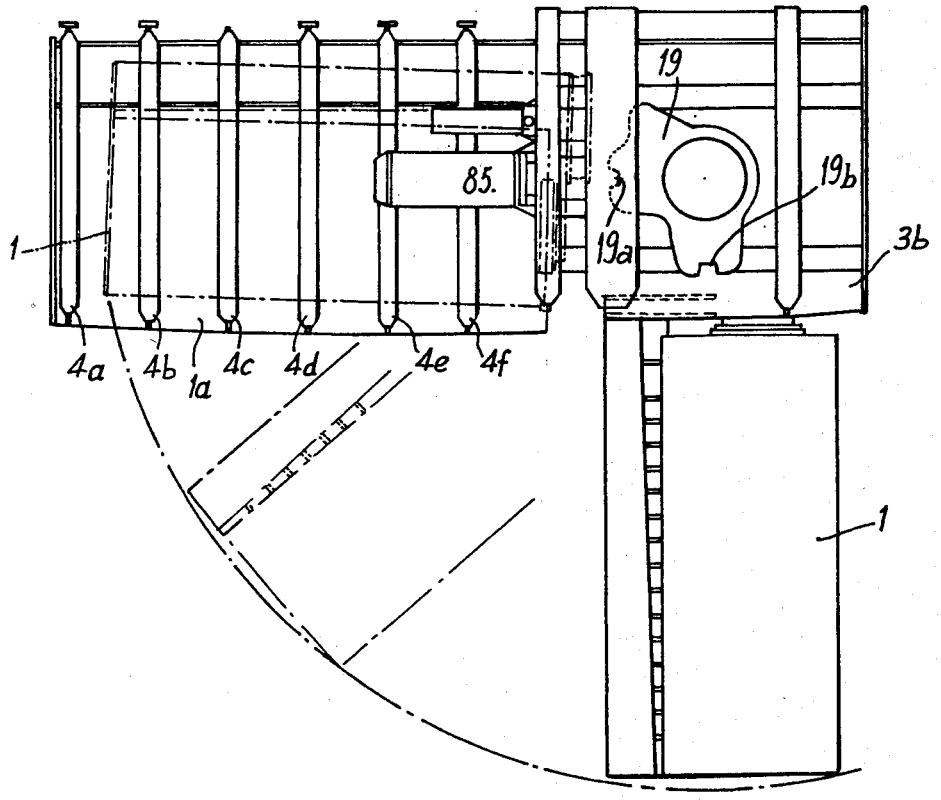
FIG. 2 is a plan view corresponding to FIG. 1 and showing the extraction and retraction movements of the fin.
Figure 4:
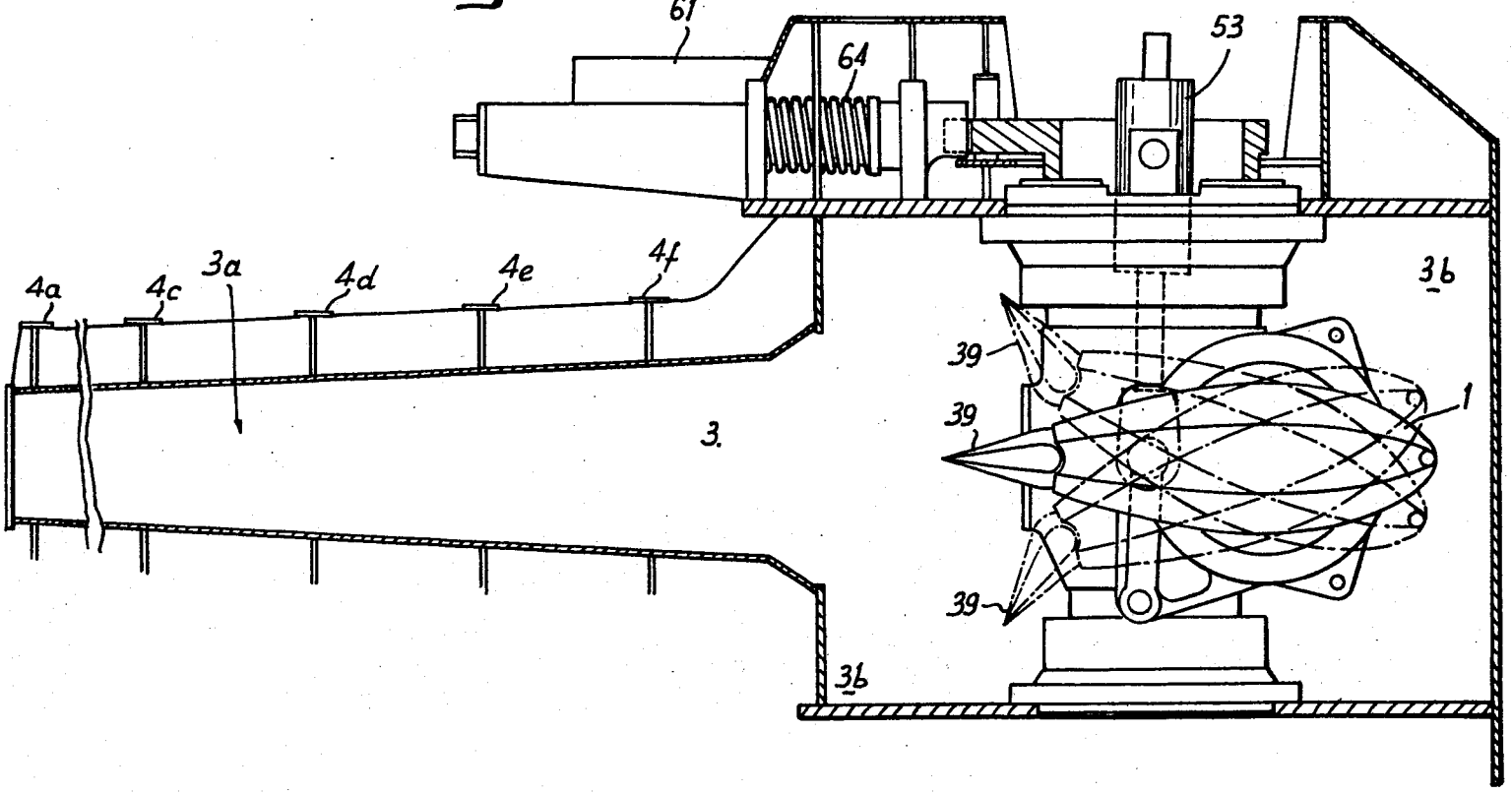
FIG. 4 is a face elevation view, partly in cross-section, corresponding to FIG. 1.

With reference to the drawings, the ship stabilizer according to the invention is made of two fins 1 of which only one is shown in FIG. 1 protruding from the hull 2 of a ship. The fins 1 are of identical design, each of which presenting, when seen from the front, substantially the shape of a sugar loaf or rounded dihedron (FIG. 4) and, seen in a plane, a rectangular shape (FIG. 2). However, each fin 1 has a section which is perfectly symmetrical relative to its horizontal medium plane and has substantially a flattened ovoid shape (FIG. 4). The fins are mounted symmetrically on either side of the hull 2, and since they are made in the same way, only one of said fins will be described hereafter with its control and locking mechanisms.

As shown in FIG. 1, the longitudinal axis 1*a* of each fin 1 forms with the horizontal plane PH of the ship an angle in the order of 22°. Of course, and as is shown in FIG. 1, the left hand side fin is inclined from top to bottom and, symmetrically, the right hand side fin (not shown) is also inclined from top to bottom in a similar way.

In order to house the mechanisms as well as a fin 1 when it is retracted, the side walls of the hull 2 are formed below the floating line with a recess 3 (FIGS. 1 and 4) of elongated shape. The rear portion 3*a* (FIG. 4) of the recess 3, reinforced by a number of stiffening members 4*a*, 4*b*, 4*c*, 4*d*, 4*e*, 4*f*–4*n* is provided for housing the fin 1 when retracted (FIG. 2), whereas the front portion 3*b* of the recess 3 has the shape of a rectangular box for housing the transmission mechanisms for the pivoting movement and the adjustment of the inclination of the fin 1. To this effect, the fin 1 is mounted, through a shaft 5 (FIG. 1), on a casing 6 of substantially cylindrical shape.

The casing 6, of a monoblock construction; which occupies a vertical position inside the box 3*b* and which, due to its rotation, controls the "retracted" and "extracted" positions of the fin 1, is made water-tight in relation to the box 3 which is filled with water. For that purpose, the lower portion 6*a* of the casing 6 (FIG. 5) is mounted with the interposition of gaskets 7, 7*a*, 8 (FIG. 5) in a sleeve 9 and the assembly is centered by a ring 10 in a dished bearing 10*b*. The lower partition wall 11 of the box 3*b* supports the bearing 10*b*. The bearing 10*b* has a hollow space 13 which, once filled with a fluid, and preferably oil, provides on the one hand a perfectly tight assembly and facilitates on the other hand the rotation of the casing 6 when the fin 1 has to be extracted or retracted.

Figure 5:
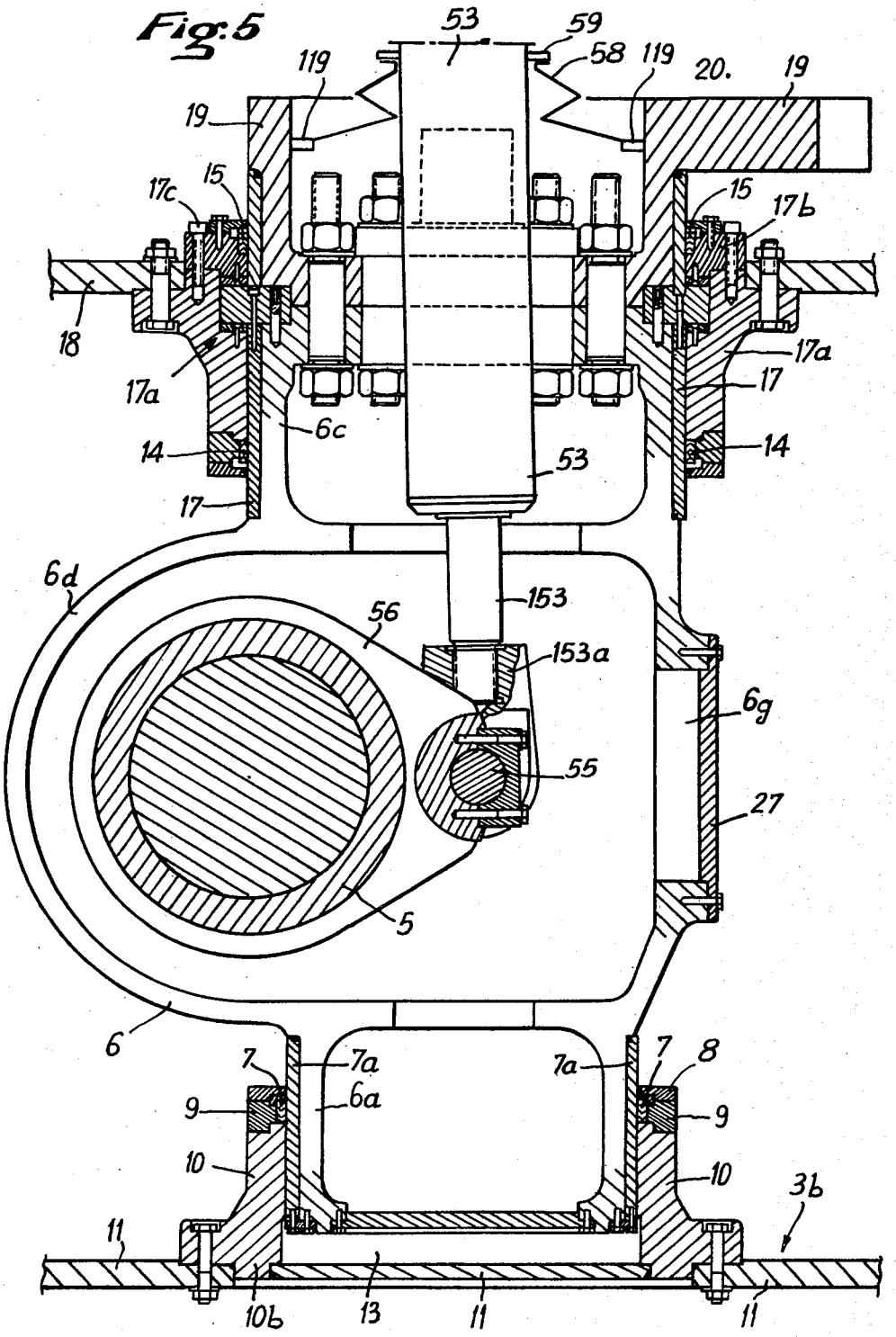
FIG. 5 is a transverse enlarged elevation view, partly in cross-section, of the control box of the fin, as viewed substantially along line V—V of FIG. 1.

The outside of the upper portion 6c of the casing 6 carries a circular sleeve 17 on which are mounted sealing gaskets 14, 15 maintained in position by a socket 17a fixed by any convenient means on the upper partition wall 18 of the box 3. Reference 17b designates a ring covering the socket 17a at its upper portion, this ring being maintained by traversing bolts 17c. Gaskets 7, 14 and 15 are cut sealing joints of the stuffing box type allowing a further tightening when a leakage occurs and which can be replaced without dismantling the bearings. As shown in FIG. 5, the upper portion 6c of the casing 6 extends through the upper portion 18 of the box 3 and terminates at its upper end with a control plate 19. The plate 19 is in a water tight compartment 20 provided for containing the elements controlling the rotation and locking of the casing 6 and, therefore, also the locking of the fin 1 either in its "extracted" position or in its "retracted" position.

Figure 6:
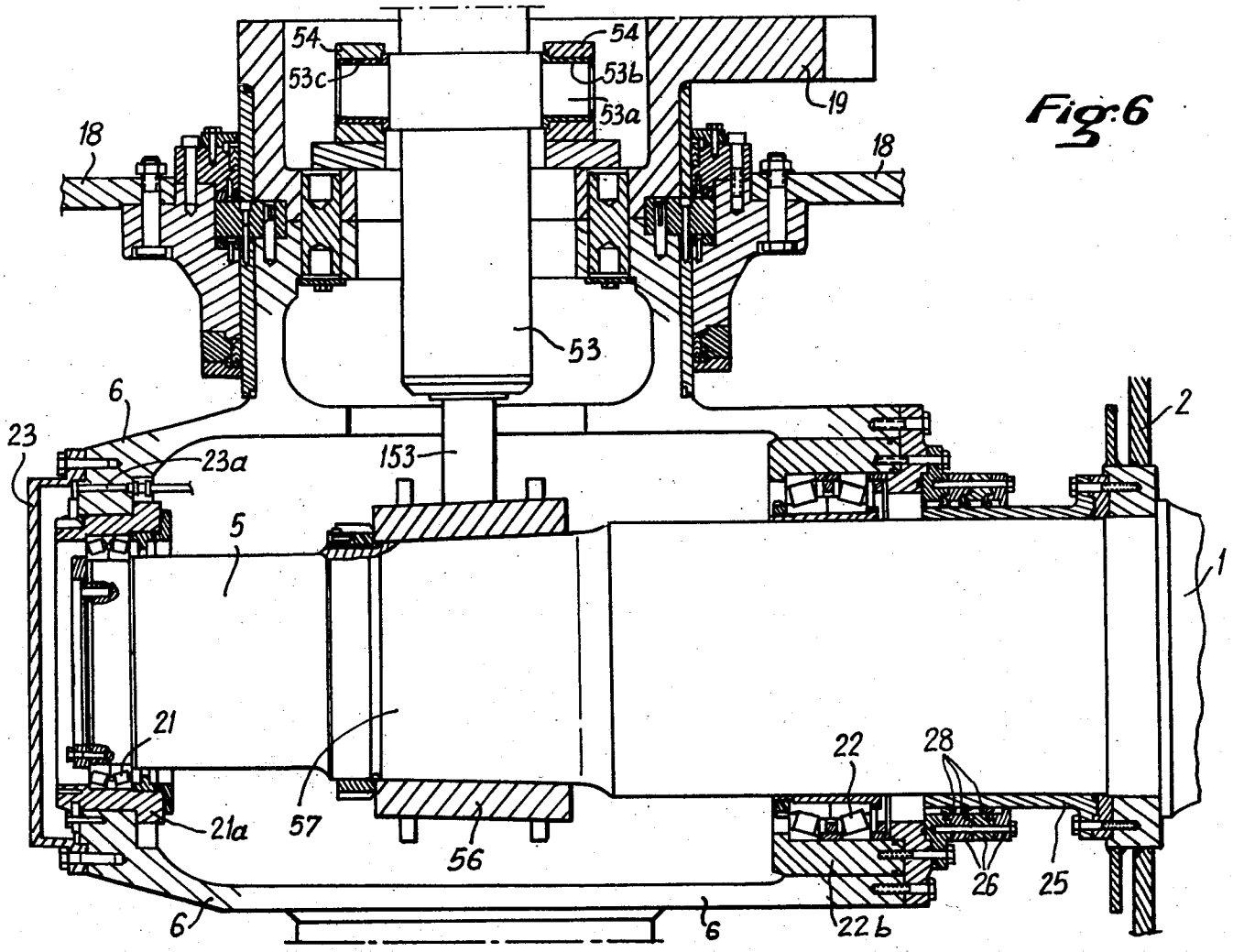
FIG. 6 is an enlarged longitudinal elevation view, partly in cross-section, of the control box of FIG. 5.

As shown in FIGS. 1, 4, 5 and 6, the casing 6 is formed in its medium portion with a bulging 6d containing the shaft 5 carrying the fin 1. The shaft 5 is supported by roller bearings 21 and 22, the centering rings of which 21a and 22b are fixedly mounted onto the casing 6. The tightness of the bearing 22, 22b is provided by means of an assembly formed of a sleeve 25, rings 26 and gaskets 28 (FIG. 6). With respect to the bearing 21, 21a, this bearing is protected in the casing 6 by an inspection panel 23 and correctly lubricated by circuits 23a.

Figure 15:
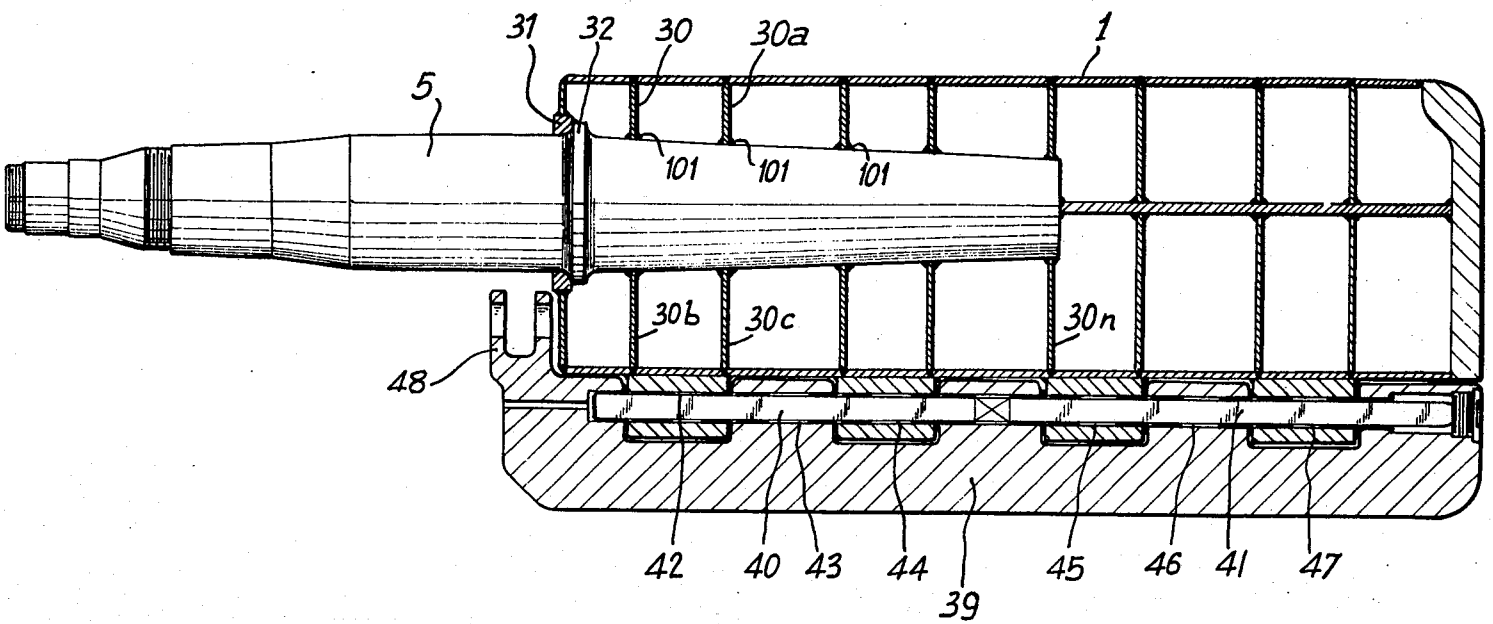
FIGS. 15 and 16 show in detail two fixation modes of the fin on the shaft controlling its slant angle.
Figure 16:
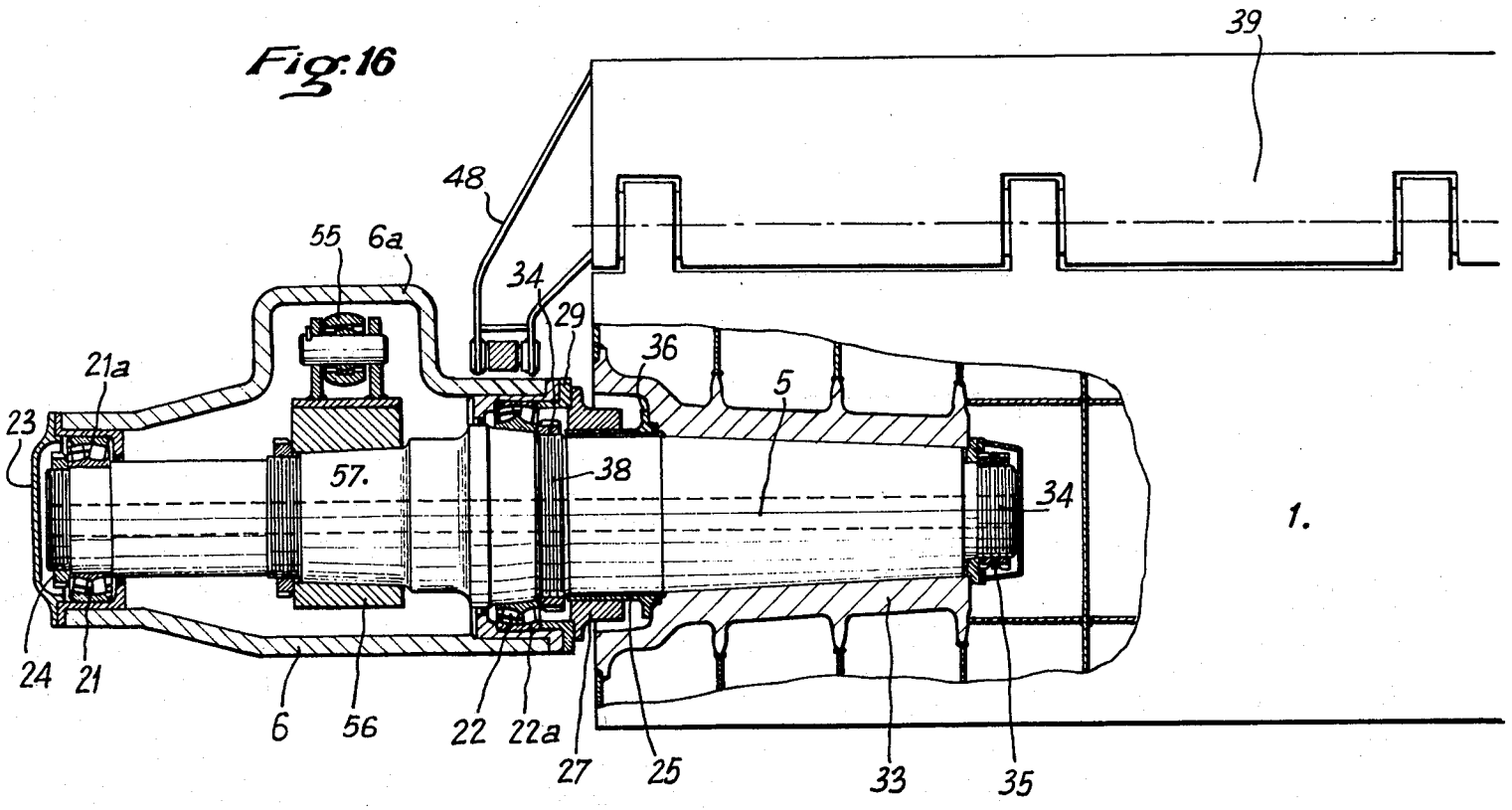

FIGS. 15 and 16 show two different ways of mounting the main fin. In a mounting according to FIG. 15, the shaft 5 penetrates rather deeply inside the fin 1 and is connected to said fin by soldering points 101 made on the one hand in the area of the ribs 30, 30a, 30b, 30c–30n and on the other hand on the edge 31 of the side opening of the fin 1 and behind a neck portion 32 provided to this effect on shaft 5.

In the embodiment shown in FIG. 16, a conical sleeve 33 fixedly connected to the fin 1 is provided for receiving the end, also of a conical shape 1, of the shaft 5 on the end of which is a threading 34. The fin 1 is then fixed to the shaft 5 by pressing it onto the conical portion of the latter by an oil pressure system for example. It is maintained by nuts 35 screwed on the threaded end 34 of the shaft 5. This embodiment facilitates the replacement either of the shaft 5 or of the fin 1 when a damage has been caused to either of them.

An auxilliary flap 39 is pivotally mounted onto the rear longitudinal edge of the main fin 1 by means of pins 40, 41 of small length in order to facilitate the assembling and disassembling of the auxilliary flap 39. The rotation of the pins 40, 41 is effected inside sockets 42–47 made of celoron (a phenolic fabric laminate) or any appropriate material and placed inside the bearings of the main fin. The lubrication of the sockets 42–47 is made by sea water.

Figure 13:
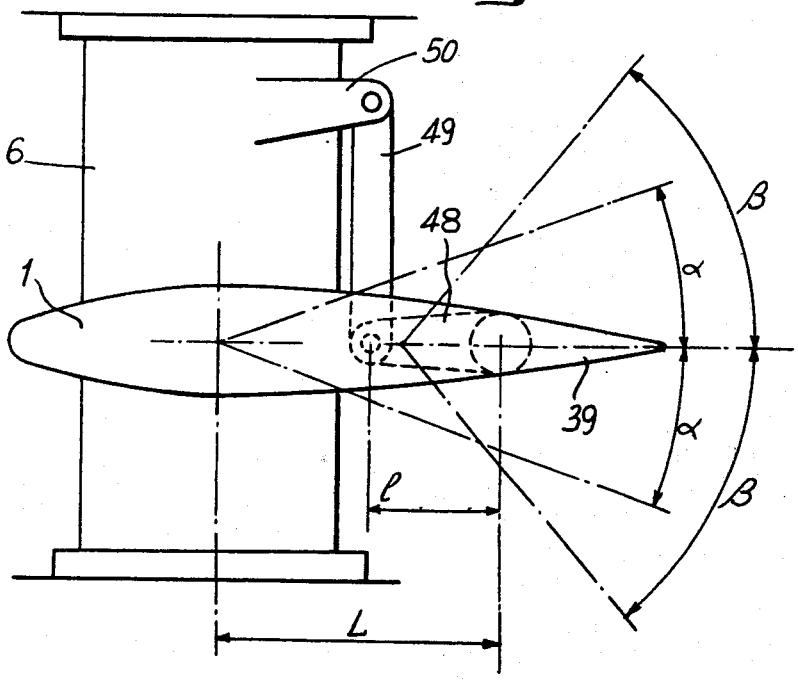
FIGS. 13 and 14 show in cross-section two different controls of an auxilliary flap.
Figure 14:
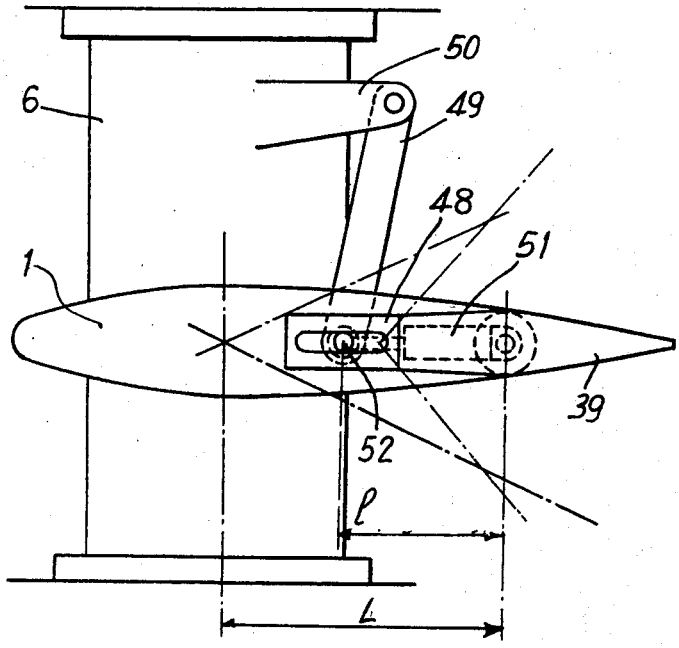

The inclination angle of the auxilliary flap 39 is automatically adjusted as a function of that of the main fin 1 through an arm 48 and a connecting rod 49 articulated on an arm 50 rigidly connected to the orientable casing 6 (FIGS. 4 and 13). This embodiment makes possible to vary the inclination angle $\beta$ of the auxilliary flap 39 relative to the angle $\alpha$ of the main fin 1, according to a definite relationship. However, it is also possible to adjust the inclination angle of the auxilliary flap 39 relative to that of the main fin 1 by varying the length of the arm 48 by means of a double action jack 51 which causes a pin 52 connecting the arm 48 with the connecting rod 49 (FIG. 14) to slide in a groove of the arm 48.

The inclination angle of the main fin 1 is adjusted by a double action jack 53 provided inside the rotation casing 6. The cylinder of the jack 53 is articulated in two bearings 54 fixedly attached to the casing 6 and its piston rod 153 is connected by a pin 55 to a lever 56 which is fixed on the conical portion 57 of shaft 5 of the main fin 1 (FIGS. 1, 5, 6).

As particularly shown in FIG. 6, the articulation of the body of the jack 53 is provided through a pin 53a carried by the bearings 54 while the articulation of the piston rod 153 is provided by a fork 153a mounted on the ends of pin 55 rigidly connected to the lever 56.

The pin 55 is accessible through an opening 6g of the casing closed by the plate 27. The jack 53 is connected by articulated tubes to a variable capacity and double action pump controlled by a servo-valve which is not shown. The servo-valve is actuated by signals from a servo-control box.

A flexible type sealing device formed for instance of bellows 58 is fixed on the one hand onto the flange 59 of the jack 53 and on the other hand onto the control plate 19 at 119, thereby enabling to maintain the inside of the casing 6 filled with oil under a pressure which is slightly superior to the pressure of the water due to immersion of the ship. This disposition provides a lubrication of the bearings 21 and 22, pin 55 and journals of the pin 53a, 53b, 53c of the jack 53 in the bearings 54.

Figure 3:
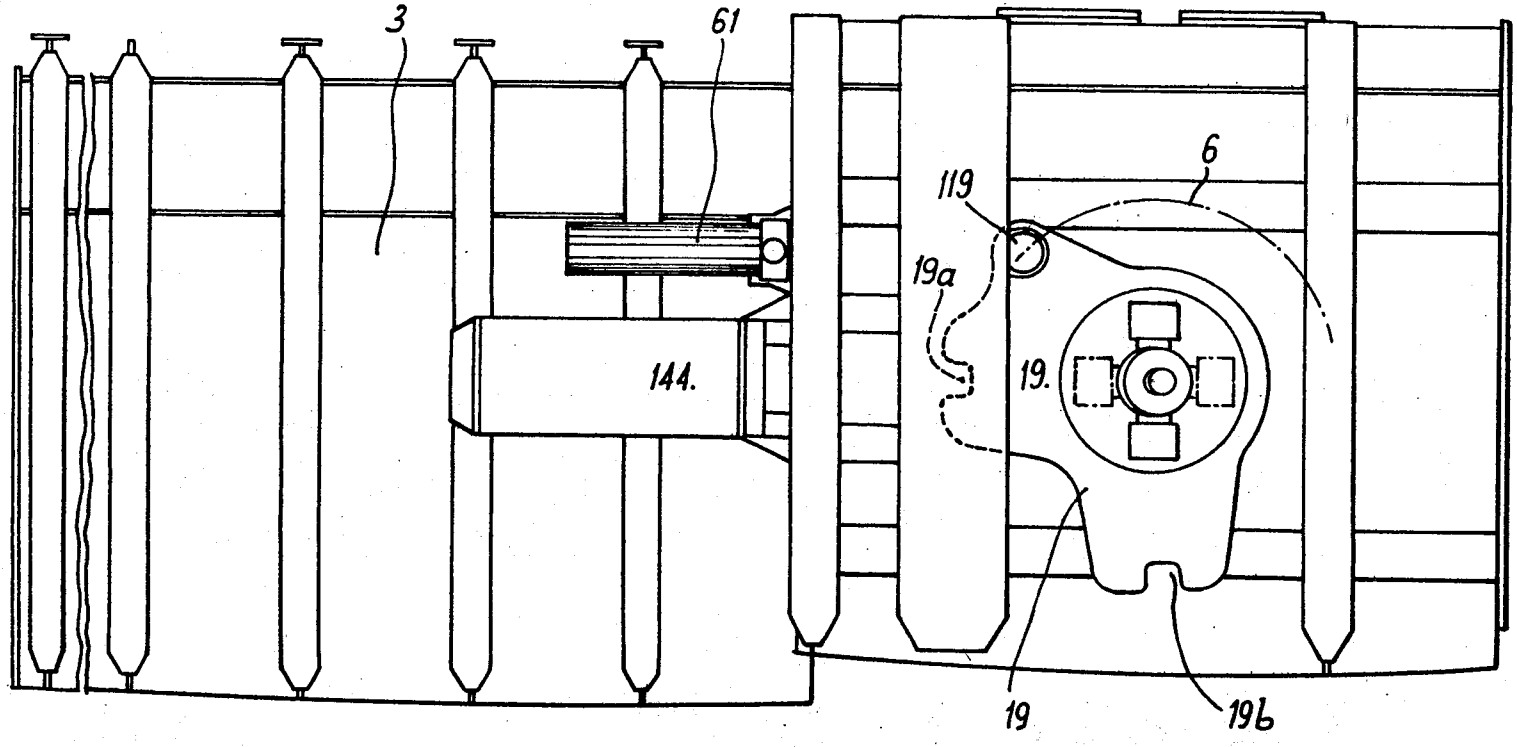
FIG. 3 is an enlarged plan view of a portion of FIG. 2.

The rotation of the casing 6 carrying the fin 1 is controlled by a double action jack 61 (FIGS. 3, 4 and 8) connected, on the one hand, to a web 62 of the hull 2 and on the other hand to the control plate 19 of the casing 6. In order to lock the fin 1 in its "extracted" position as well as in its "retracted" position, the control plate 19 is formed on its periphery with two notches 19a and 19b arranged at about 90° from each other and engaged with a lock 63. The lock 63 is maintained in the notch 19a or 19b by a spring 64 and is controlled by a jack 65 provided for the locking and unlocking operations.

Figure 7:
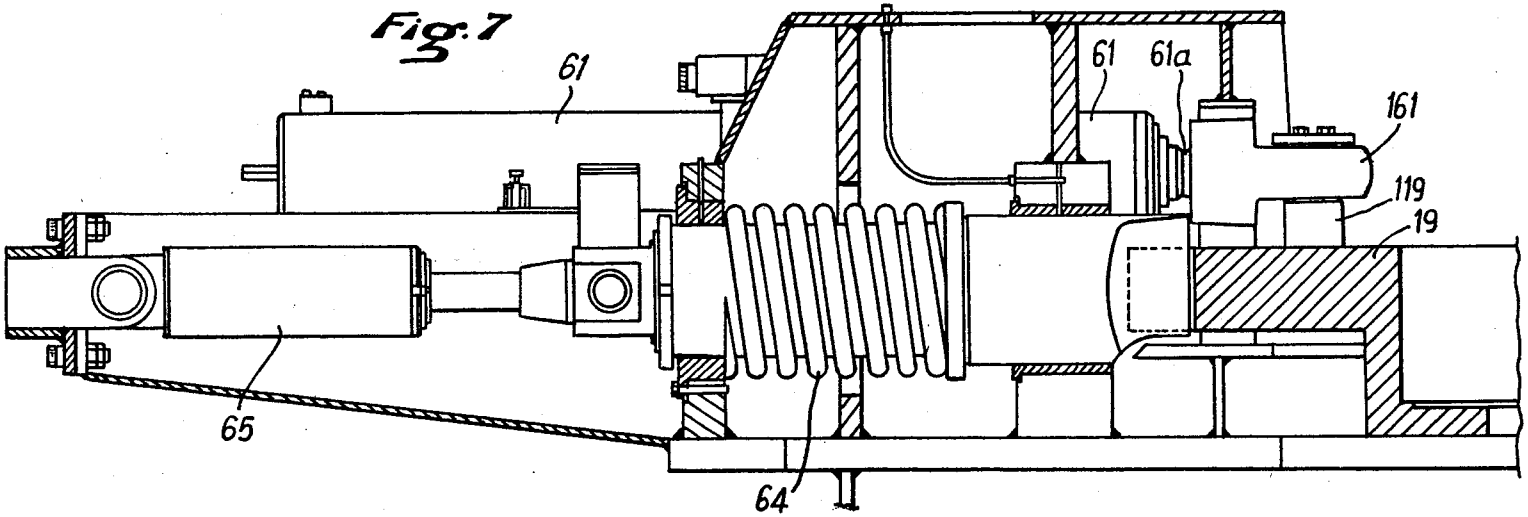
FIG. 7 is an enlarged longitudinal elevation view, partly in cross-section, of the upper portion of the control box of FIGS. 5 and 6.
Figure 9:
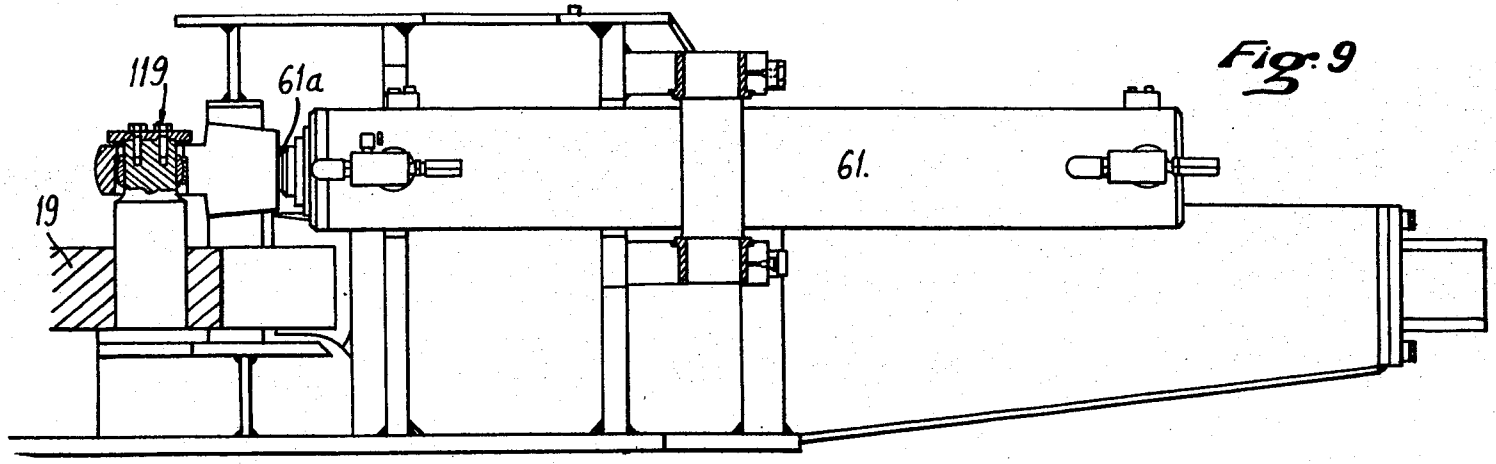
FIG. 9 is an elevation view of a detail of FIG. 7.
Figure 8:
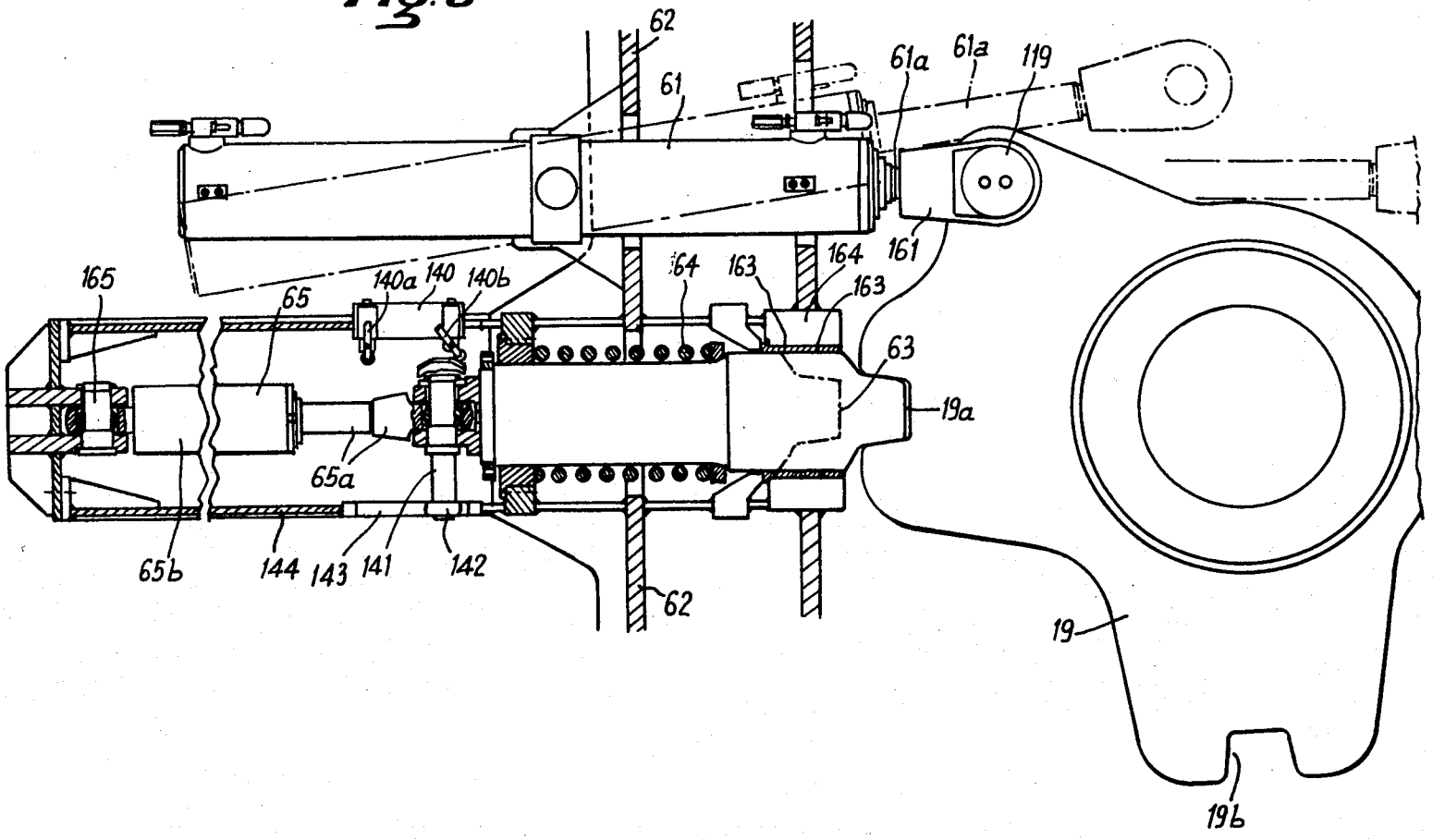
FIG. 8 is a plan view corresponding to FIG. 7.
Figure 10:
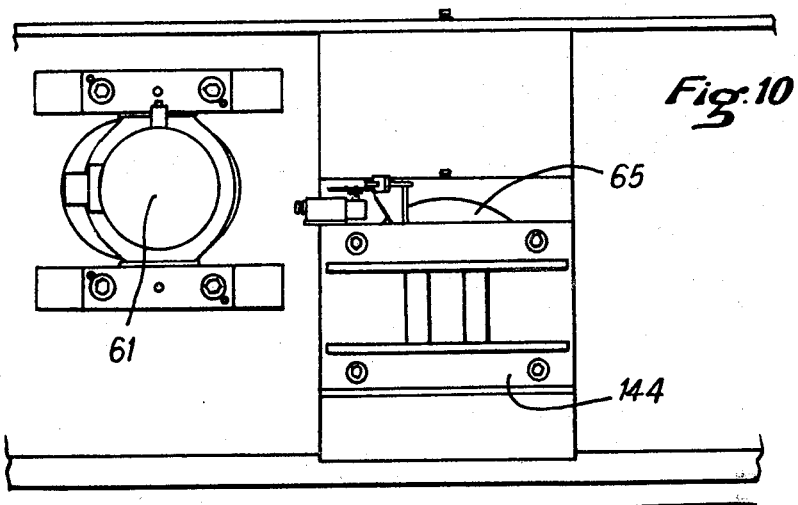
FIGS. 10, 11 and 12 are enlarged elevation views, partly in cross-section, of details of FIG. 8.
Figure 11:
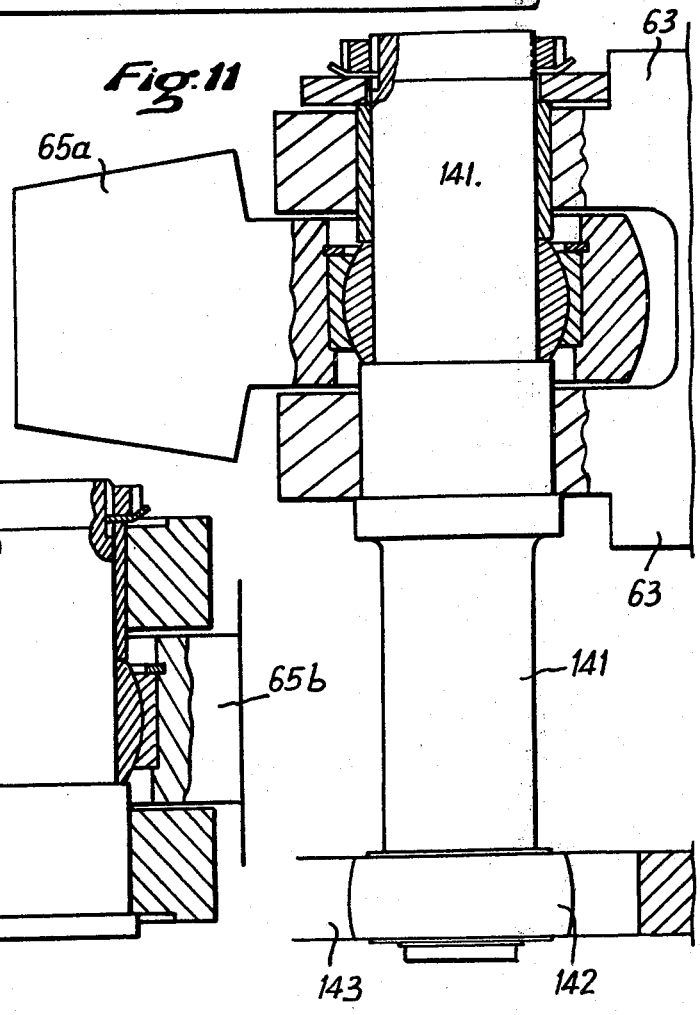
Figure 12:
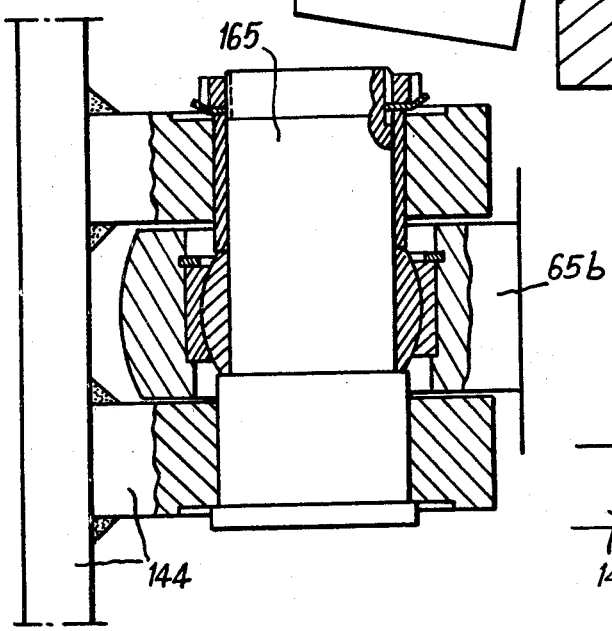

In the locked position shown in FIGS. 1, 7 and 8, the lock 63 is pushed inside the notch 19a or 19b by a spring 64. Upon unlocking the control plate 19 for extracting or retracting the fin 1 by means of the jack 61, the spring 64 is pressed by further retracting the piston rod 65a of the jack 65 so as to free the lock 63 from the corresponding notch 19a, 19b. From this moment, it is possible to retract or extract the fin 1 by driving in rotation the casing 6 which carries the fin, by means of the jack 61, the piston rod 61a of which causes the rotation of the plate 19 as shown in FIG. 8. It will be noted that the connection between the plate 19 and the piston rod 61a is provided by a fork 161 rigidly connected to the piston rod 61a and pivotally mounted on an axis 119 fixed to the plate 19.

In order to thereafter recenter the fin 1, the jack 65 is fed with oil under pressure and pushes the lock 63. The lock 63 penetrates then into the notch 19a to 19b and thereby centers the fin by a wedge effect.

Once the fin is centered, the spring 64 maintains the lock 63 bearing on the plate 19. An electrical device 140 (FIG. 8) allows controlling easily the position of the lock 63 the displacement of which is made perfectly rectilinear due to the fact that its rear portion is guided by a finger 141 provided with a roller 142 freely sliding inside an opening 143 formed in the armature 144 containing the jack 65. The electrical device 140 is controlled by pivotable fingers 140*a*, 140*b* so as to stop actuation of the jack 65 at the end of its stroke. The jack 65 is mounted at its rear portion 65*b* on an articulation 165 (FIG. 8) so as to ensure also the perfect centering of the movement allowing the positioning or retraction of the lock 63 in the notches 19*a*, 19*b* of the control plate 19. For assisting movement of the lock 63, sliding rings 163 are provided onto the armature 164 serving as a guide to it. The retraction of the fin inside its housing may be arranged according to two alternatives. One alternative consists in retracting the fin from the head of the ship towards the stern. In this disposition, the lock receives the efforts due to the drag of the fin. A second alternative consists in retracting the fin from the stern towards the head of the ship. In this alternative, the effort due to the drag of the fin is applied on a mechanical abutment inside the housing and on which comes to bear a protrusion of the casing 6.

Figure 17:
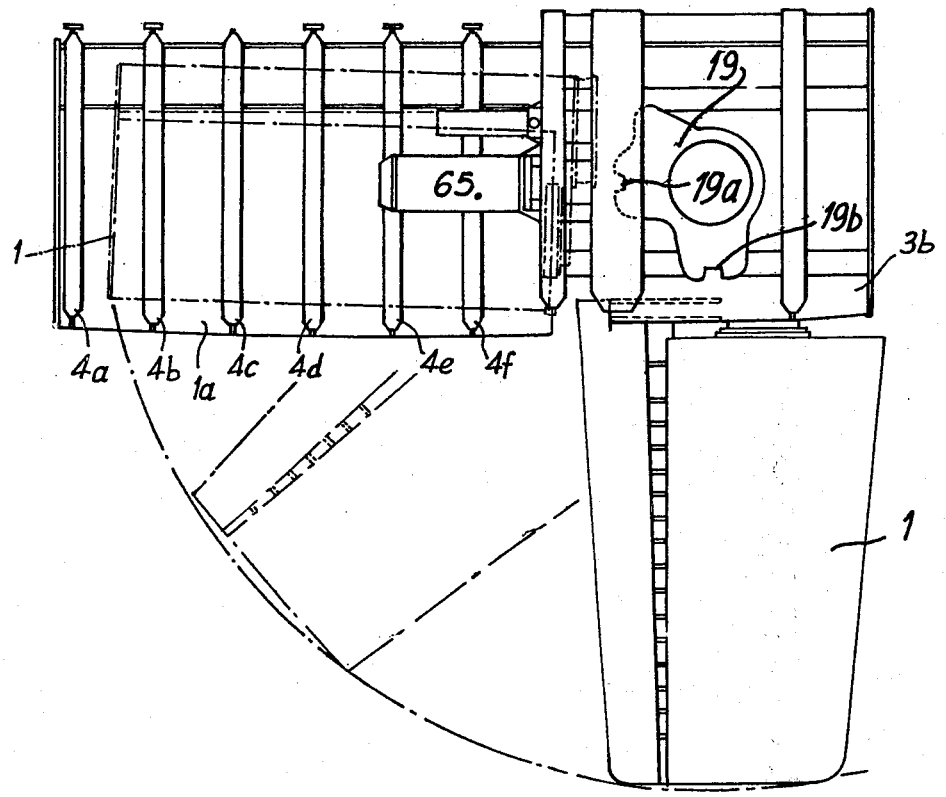
FIG. 17 is a plan view similar to that of FIG. 2 showing an alternative embodiment of the fin.

In FIG. 17 there has been shown, seen in a plane, the trapezoidal shape of the fin 1, the larger base of which is placed near the hull, whereas the smaller base is placed outside thereby allowing, on the one hand, a better stabilization effect and, on the other hand, a better penetration in the water due to that shape which is a more hydro-dynamic shape. As in FIG. 1, each fin is perfectly symmetrical relative to its horizontal medium plane, and in cross-section, each fin has substantially a flattened ovoid shape.

Figure 18:
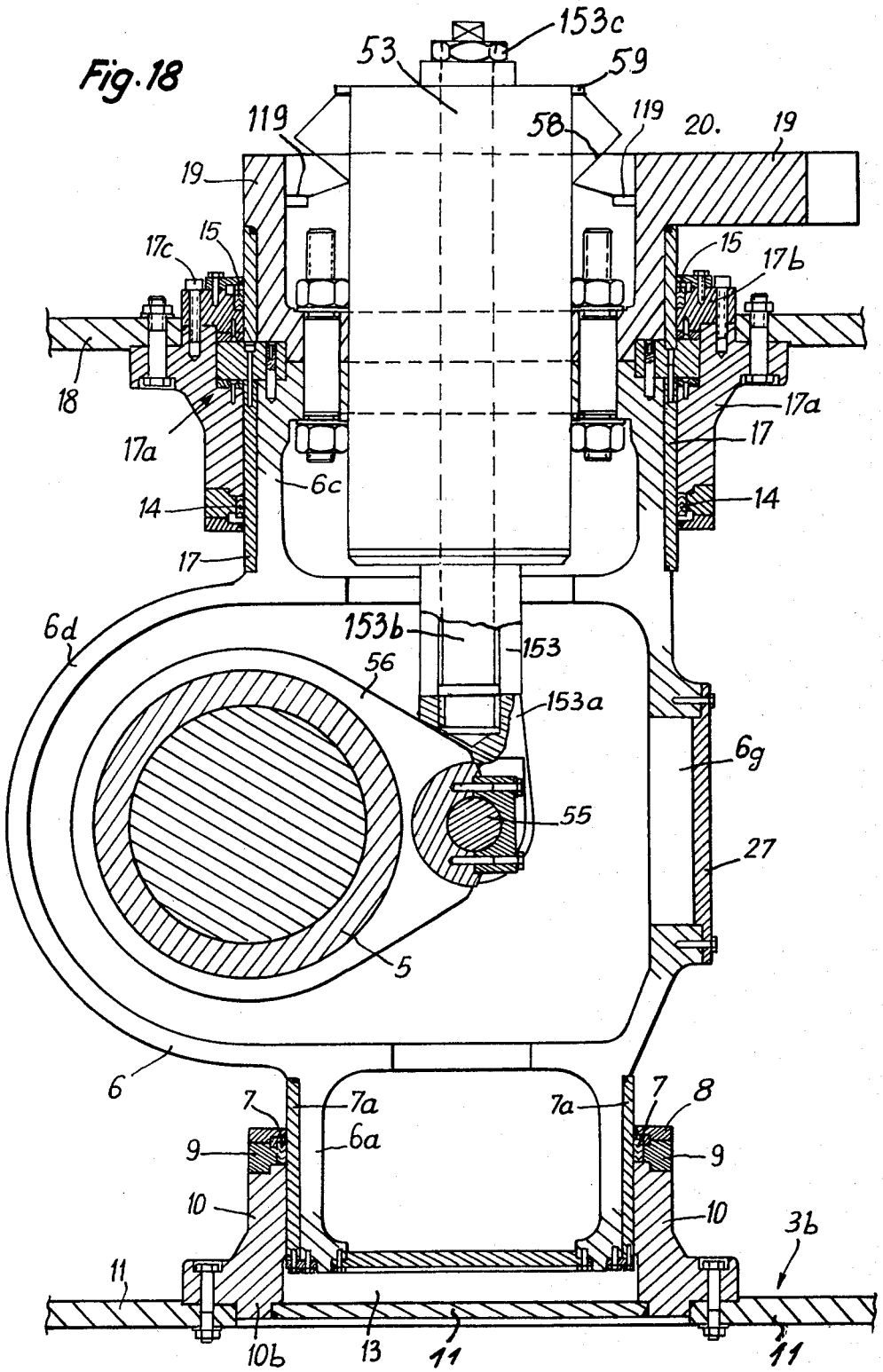
FIG. 18 is an elevation cross-sectional view, similar to that of FIG. 5, showing a further development of the invention.

FIG. 18, corresponding substantially to FIG. 5, shows that the piston rod 153 of the jack 53 is hollow and contains a tie rod 153*b* connected by any convenient means, as for instance by screwing, to the fork 153*a* and allowing the manoeuvre of each fin, whereas the other portion of the tie rod 153*b* is fixed via a nut 153*c* on the top portion of the cylinder of the jack 53. Thus, by simply unscrewing the nut 153*c*, one may easily remove the tie rod 153*b*, and then the body of jack 53 if it is necessary for a repair. All the disassembling operation may be carried out from the inside of the ship away from the water and without difficult interventions. Reassembling the body of the jack is carried out in the same manner from the inside of the ship and the tie rod 153*b* may be put back after in order to fix the whole assembly.

I claim:

1. A ship stabilizer with fins retractable into the hull of a ship, comprising:

at least one pair of fins mounted on either side of the hull of the ship, each said fin being connected to a connectable casing;

means for retracting each of said fins from an operative position into a retracted position in a housing formed in the hull of the ship below the floating line of the ship by rotating said casing;

an auxilliary flap pivotally mounted on the rear edge of each said fin;

inclination means for varying the angle of inclination of said fin with respect to said casing; and adjusting means for adjusting the inclination angle of said auxilliary flap as a function of the inclination angle of said main fin, comprising a first arm fixedly connected to said auxilliary flap, a connecting rod, disposed substantially perpendicular to the plane of said fin, pivotally connected at one end to said first arm and pivotally mounted at the other end thereof on said casing; and means for varying the effective length of said first arm comprising a double action jack which causes the point of intersection of said first arm and said connecting rod to be moved along the axis of said first arm.

2. A ship stabilizer with fins retractable into the hull of a ship, comprising:

a housing formed on each side of the hull of the ship;

a monoblock, water-tight casing vertically mounted in each said housing;

a shaft, connected at one end thereof, to each said casing;

a stabilizer fin fixed to each said shaft;

a double-action jack connected to said housing and to said casing to cause said casing and attached shaft and fin to rotate to and from operative and retracted positions; and adjusting means for adjusting the inclination angle of said fin and comprising a double action jack partly housed within said casing and connected to said shaft by means of a lever fitted on a frustoconical portion of said shaft without keying; p1 wherein wherein said casing is made water-tight by means of a bellows connected at one end to said casing and at the other end thereof to said jack of said adjusting means, said bellows being filled with oil.

3. A ship stabilizer with fins retractable into the hull of a ship, comprising:

a housing formed on each side of the hull of the ship;

a monoblock, water-tight casing vertically mounted in each said housing;

a shaft connected, at one end thereof, to each said casing;

a stabilizer fin fixed to each said shaft;

a double-action jack connected to said housing and to said casing to cause said casing and attached shaft and fin to rotate to and from operative and restracted positions; and adjusting means for adjusting the inclination angle of said fin and comprising a double action jack partly housed within said casing and connected to said shaft by means of a lever fitted on a frustoconical portion of said shaft without keying, said double action jack of said adjusting means having a hollow piston rod containing a tie rod therein, said tie rod having one end removably fixed to said shaft, the other end thereof being removeably fixed to the top of the cylinder of said jack, whereby the tie rod may be easily dismounted and then the jack brought out from the inside of the ship without intervening outside the hull.

4. A ship stabilizer in accordance with claim 1, wherein said casing is of a water-tight monoblock construction and mounted in a substantially vertical position in said housing, wherein each said fin is fixed to said casing by means of a shaft, and wherein said means for retracting said fins includes a double action jack causing said casing and attached fin to rotate.

5. A ship stabilizer in accordance with claim 4 further including adjusting means for adjusting the inclination angle of said fin comprising a double action jack partly housed within said casing and connected to said shaft by means of a lever fitted on a frustoconical portion of said shaft without keying.

6. A ship stabilizer in accordance with claim 4, wherein said monoblock casing has two orthogonal portions which sealingly pivot within the housing.

7. A ship stabilizer in accordance with claim 6, wherein said monoblock casing pivots inside rings and sleeves made water-tight by bearings comprising cut sealing joints housed in dismountable means, said sealing joints being of the stuffing box type allowing a further tightening when leakage occurs and which can be replaced without dismantling said rings.

8. A ship stabilizer in accordance with claims 2, 3 or 4, wherein each said fin is fixed to said respective shaft by means of a conical sleeve fixedly connected to the fin and which is force-fitted onto the entire length of an outer frustoconical portion of said shaft, said conical sleeve being fixed onto the shaft by means of a nut screwed onto a threaded end of said shaft or equivalent means.

9. A ship in accordance with one of claims 1, 2 or 3, further including hydraulic control means for centering said fin in the operative or retracted positions thereof and spring means for locking said fins in said positions.

10. A ship stabilizer in accordance with one of claims 1 to 3 wherein each of said fins are identical and have, when seen from the front, substantially the shape of a thick dihedron, and when seen in a plane a trapezoidal shape, each said fin being symmetrical relative to its horizontal medium plane and having, in cross-section, substantially a flattened ovoid shape.

11. A ship stabilizer in accordance with claims 2 or 3, further including an auxilliary flap pivotally mounted on the rear edge of each said fin.

12. A ship stabilizer in accordance with claim 11 further including adjusting means for adjusting the inclination of said auxilliary flap as a function of the inclination angle of said main fin, comprising a first arm fixedly connected to said auxilliary flap and a connecting rod, disposed substantially perpendicular to the plane of said fin, pivotally connected at one end to said first arm and pivotally mounted at the other end thereof on said casing.

* * * * *

UNITED STATES PATENT AND TRADEMARK OFFICE

CERTIFICATE OF CORRECTION

PATENT NO. : 4,273,063

DATED : June 16, 1981

INVENTOR(S) : Jean BERNE

It is certified that error appears in the above-identified patent and that said Letters Patent are hereby corrected as shown below:

Column 4, line 59, "19a to 19b" should read --19a or 19b--

Column 6, line 22 (claim 2, line 17), delete "pl wherein"

Signed and Sealed this

*Second* Day of *February 1982*

[SEAL]

*Attest:*

GERALD J. MOSSINGHOFF

*Attesting Officer*

*Commissioner of Patents and Trademarks*